US012729479B2

(12) United States Patent
Djerekarov et al.

(10) Patent No.: US 12,729,479 B2
(45) Date of Patent: Sep. 8, 2026

(54) COOL DOWN LOGIC FOR CONDENSING TYPE DRYERS

(71) Applicant: Haier US Appliance Solutions, Inc., Wilmington, DE (US)

(72) Inventors: Jivko Ognianov Djerekarov, Louisville, KY (US); David Scott Dunn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 383 days.

(21) Appl. No.: 18/472,495

(22) Filed: Sep. 22, 2023

(65) Prior Publication Data

US 2025/0101671 A1 Mar. 27, 2025

(51) Int. Cl.

| | |
|---|---|
| ***D06F 58/24*** | (2006.01) |
| ***D06F 58/38*** | (2020.01) |
| ***D06F 105/30*** | (2020.01) |
| ***D06F 105/32*** | (2020.01) |
| ***D06F 105/36*** | (2020.01) |
| ***D06F 105/48*** | (2020.01) |
| ***D06F 105/52*** | (2020.01) |
| *D06F 25/00* | (2006.01) |
| *D06F 58/02* | (2006.01) |
| *D06F 103/36* | (2020.01) |
| *D06F 105/24* | (2020.01) |

(52) U.S. Cl.

CPC ..... *D06F 58/24* (2013.01); *D06F 58/38* (2020.02); *D06F 25/00* (2013.01); *D06F 58/02* (2013.01); *D06F 2103/36* (2020.02); *D06F 2105/24* (2020.02); *D06F 2105/30* (2020.02); *D06F 2105/32* (2020.02); *D06F 2105/36* (2020.02); *D06F 2105/48* (2020.02); *D06F 2105/52* (2020.02)

(58) Field of Classification Search

CPC ..... D06F 58/38; D06F 58/02; D06F 58/24; D06F 25/00; D06F 2103/36; D06F 2105/30; D06F 2105/36; D06F 2105/32; D06F 2105/48; D06F 2105/24; D06F 2105/52

See application file for complete search history.

(56) References Cited

U.S. PATENT DOCUMENTS

| | | | | |
|---|---|---|---|---|
| 10,094,065 | B2 | 10/2018 | Kim et al. | |
| 2011/0041260 | A1 * | 2/2011 | Balinski | D06F 39/04 8/159 |
| 2019/0127905 | A1 * | 5/2019 | Kim | D06F 58/45 |

(Continued)

FOREIGN PATENT DOCUMENTS

| | | | | |
|---|---|---|---|---|
| BR | 112015011965 | B1 * | 7/2021 | D06F 58/38 |
| CN | 102560993 | A | 7/2012 | |

(Continued)

*Primary Examiner* — Benjamin L Osterhout

(74) *Attorney, Agent, or Firm* — Dority & Manning, P.A.

(57) ABSTRACT

A method of operating a laundry appliance includes rotating a laundry basket at a tumble speed during a drying cycle of a laundry appliance and energizing a conditioning system for process air. A fan is operated at a first speed to recirculate a flow of process air for a portion of a drying cycle. The conditioning system is deenergized and the fan is operated at a second speed during a second portion of the drying cycle where the second speed less than the first speed.

18 Claims, 5 Drawing Sheets

(56) References Cited

U.S. PATENT DOCUMENTS

| | | | | |
|---|---|---|---|---|
| 2019/0145043 | A1* | 5/2019 | Beers | D06F 58/10 34/595 |
| 2021/0102333 | A1* | 4/2021 | Djerekarov | D06F 58/30 |
| 2021/0115619 | A1* | 4/2021 | Dunn | D06F 58/206 |
| 2023/0063185 | A1 | 3/2023 | Kim | |

FOREIGN PATENT DOCUMENTS

| | | | | |
|---|---|---|---|---|
| CN | 107787383 | B | 3/2021 | |
| EP | 2612963 | A1 * | 7/2013 | D06F 58/20 |
| EP | 2468950 | B1 | 4/2016 | |
| JP | 2019208859 | A | 12/2019 | |

* cited by examiner

COOL DOWN LOGIC FOR CONDENSING TYPE DRYERS

FIELD OF THE INVENTION

The present disclosure relates generally to laundry appliances, in particular to laundry appliances including a closed loop condensing type drying system.

BACKGROUND OF THE INVENTION

Condensing type dryer systems provide a closed-loop flow of process air to dry a load of wet laundry articles. A typical drying process includes a heated portion and a cooling portion. In a typical heated portion of a drying cycle, a basket tumbles the wet laundry articles as heated process air flows through the basket to pick up moisture evaporated from the articles. The process air is urged by a fan through ducts to a heat pump including an evaporator to remove some of the moisture from the air and a condenser to heat the air, and back to the basket. At the end of a drying cycle, the heater is deenergized in the cooling portion and process air is urged by a fan through the basket to facilitate cooling of the articles.

In many cases, during the cooling portion of the drying cycle, residual moisture in the closed-loop system is circulated by the process air and absorbed by the laundry articles. This can lead to laundry articles having a higher than anticipated moisture content at the end of the drying cycle, likely causing consumer dissatisfaction. Accordingly, improvements to the cooling process in a laundry appliance with a condensing type dryer would be beneficial.

BRIEF DESCRIPTION OF THE INVENTION

Aspects and advantages of the invention will be set forth in part in the following description, may be apparent from the description, or may be learned through practice of the invention.

In one exemplary aspect, a laundry appliance is provided, the appliance comprising a tub positioned within a cabinet, a basket supported for rotation within the tub, the basket defining a chamber for receipt of laundry articles for drying. The laundry appliance further comprises a conditioning system comprising a dehumidification section and a heating section, a recirculating air flow system for providing fluid communication between the chamber and the conditioning system, wherein the recirculating air flow system, the conditioning system, and the basket define a process air flow path, and a fan operable to move a flow of process air through the process air flow path. A controller is operably coupled to the conditioning system and the fan, the controller being configured to rotate the basket at a tumble speed during a drying cycle, energize the conditioning system, energize the fan to operate at a first speed to recirculate a first air flow through the recirculating air flow system during a first portion of the drying cycle, deenergize the conditioning system, and selectively energize the fan to operate at a second speed during a second portion of the drying cycle, the second speed less than the first speed.

In another exemplary aspect, a method of operating a laundry appliance is provided for a laundry appliance comprising a basket supported for rotation within a tub, a conditioning system comprising a dehumidification section and a heating section, a recirculating air flow system in fluid communication with the basket and the conditioning system, wherein the recirculating air flow system, the conditioning system, and the basket define a process air flow path, and a fan operable to move a flow of process air through the process air flow path. The method comprises rotating the basket at a tumble speed during a drying cycle, energizing the conditioning system, energizing the fan to operate at a first speed to recirculate a first air flow through the recirculating air flow system during a first portion of the drying cycle, deenergizing the conditioning system, and selectively energizing the fan to operate at a second speed during a second portion of the drying cycle, the second speed less than the first speed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
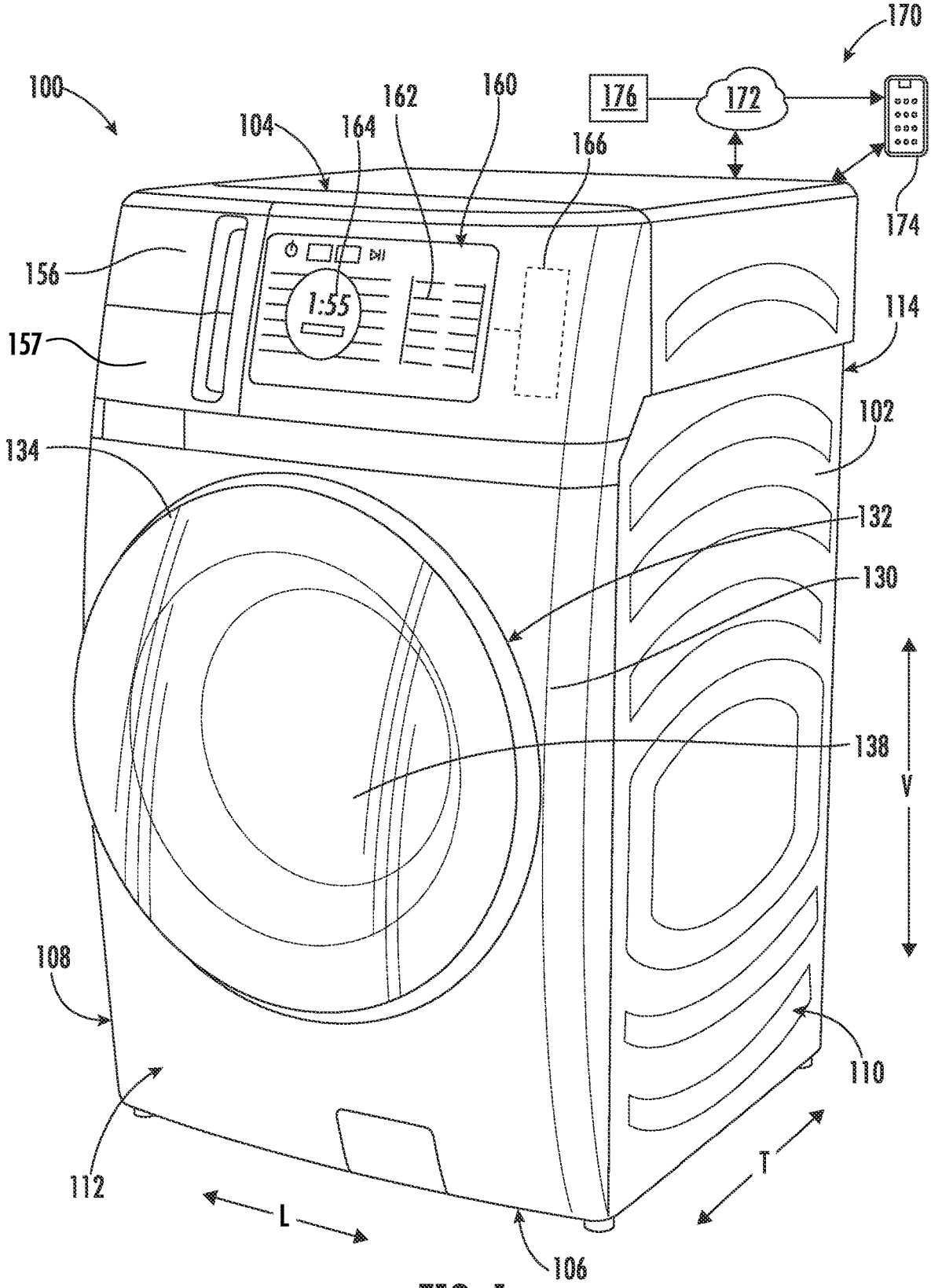
FIG. 1 provides a perspective view of a combination washer/dryer laundry appliance in accordance with exemplary embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
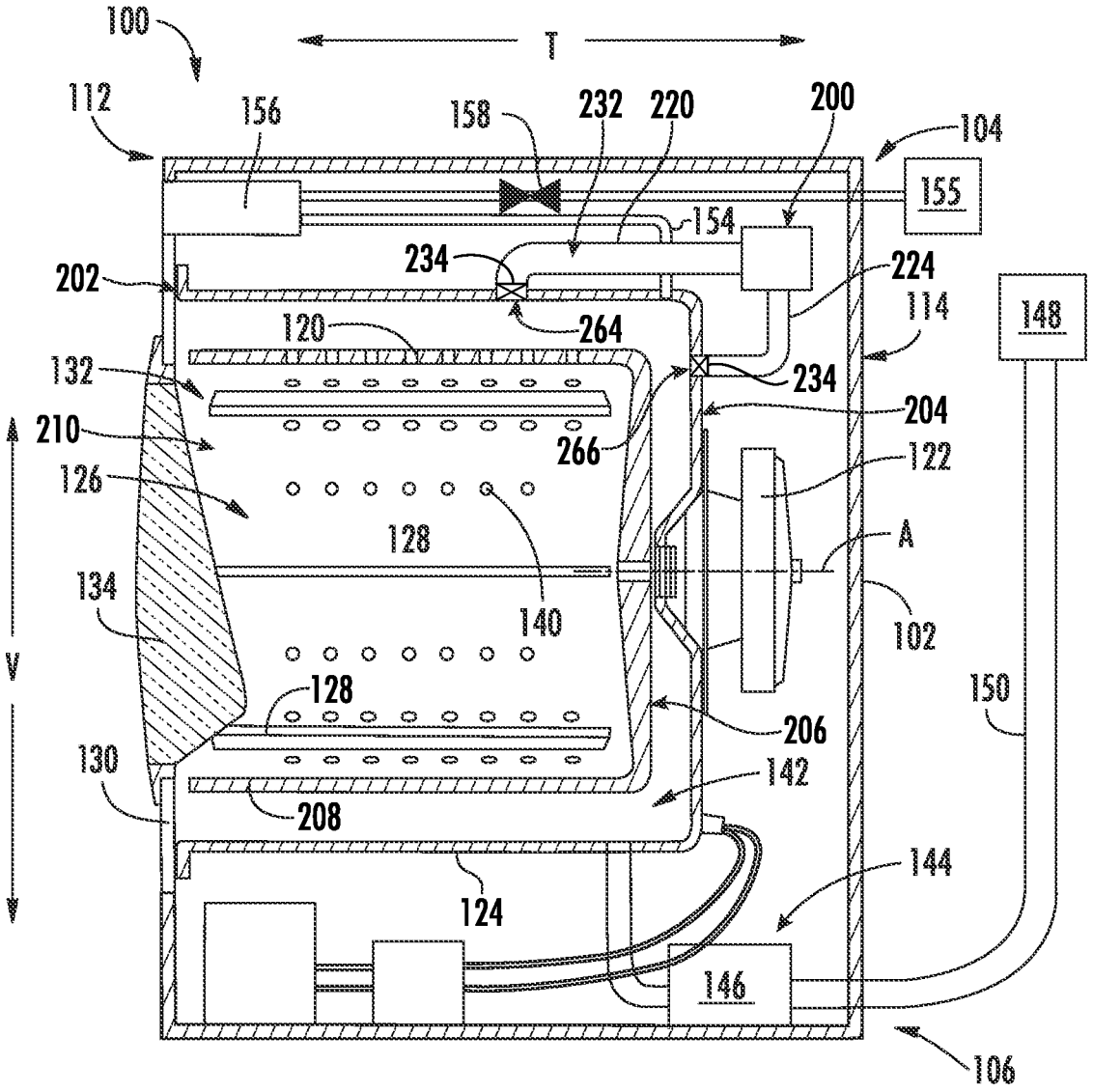
FIG. 2 provides a side cross-sectional view of the exemplary laundry appliance of FIG. 1.

Referring now to the figures, an exemplary laundry appliance that may be used to implement aspects of the present subject matter will be described. Specifically, FIG. 1 is a perspective view of an exemplary horizontal axis washer and condenser dryer combination appliance 100, referred to herein for simplicity as laundry appliance 100. Although described in reference to a combination washer and condenser dryer, one of ordinary skill in the art will recognize that the present disclosure may be practiced in any laundry appliance including a condenser dryer (i.e., having a ventless dryer feature). FIG. 2 is a side cross-sectional view of laundry appliance 100. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a laundry basket 120 is rotatably mounted (i.e., supported for rotation) within cabinet 102 such that it is rotatable about an axis of rotation A. According to the illustrated embodiment, axis of rotation A is substantially parallel to the horizontal direction (e.g., the transverse direction T), as this exemplary appliance is a front load appliance. A motor 122, e.g., such as a pancake motor, is in mechanical communication with laundry basket 120 to selectively rotate laundry basket 120 (e.g., at a tumble speed during tumble dry cycle of laundry appliance 100) under the control of controller 166. Motor 122 may be mechanically coupled to laundry basket 120 directly or indirectly, e.g., via a pulley and a belt (not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be treated together, i.e., dried together in laundry appliance 100, and may include a mixture of different or similar articles of clothing of different or similar types and kinds of fabrics, textiles, garments and linens within a particular laundering process.

In embodiments in which laundry appliance 100 is a combination washer/dryer appliance, the tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIG. 2, a plurality of baffles or ribs 128 extend from basket 120 into chamber 126. In this manner, for example, ribs 128 may lift articles disposed in laundry basket 120 and then allow such articles to tumble back to a bottom of drum laundry basket 120 as it rotates. Ribs 128 may be mounted to laundry basket 120 such that ribs 128 rotate with laundry basket 120 during operation of laundry appliance 100.

Referring generally to FIGS. 1 and 2, cabinet 102 also includes a front panel 130 which defines an opening 132 that permits user access to laundry basket 120 and tub 124. More specifically, laundry appliance 100 includes a door 134 that is positioned over opening 132 and is rotatably mounted to front panel 130. In this manner, door 134 permits selective access to opening 132 by being movable between an open position (not shown) facilitating access to a tub 124 and a closed position (FIGS. 1 and 2) prohibiting access to tub 124. Laundry appliance 100 may further include a latch assembly that is mounted to cabinet 102 and/or door 134 for selectively locking door 134 in the closed position. The latch assembly may be desirable, for example, to ensure only secured access to chamber 126 or to otherwise ensure and verify that door 134 is closed during certain operating cycles or events.

A window 138 in door 134 permits viewing of laundry basket 120 when door 134 is in the closed position, e.g., during operation of laundry appliance 100. Door 134 also includes a handle (not shown) that a user may pull when opening the door 134. Further, although door 134 is illustrated as mounted to front panel 130, it should be appreciated that door 134 may be mounted to another side of cabinet 102 or any other suitable support according to alternative embodiments.

Referring again to FIG. 2, laundry basket 120 also defines a plurality of perforations 140 in order to facilitate fluid communication between an interior of basket 120 and tub 124. A sump 142 is defined by tub 124 at a bottom of tub 124 along the vertical direction V. Thus, sump 142 is configured for receipt of and generally collects wash fluid during operation of laundry appliance 100. For example, during operation of laundry appliance 100, wash fluid may be urged by gravity from basket 120 to sump 142 through plurality of perforations 140.

A drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into tub 124. For example, spout 154 may be in fluid communication with a water supply 155 in order to direct fluid into tub 124. Spout 154 may also be in fluid communication with the sump 142. For example, pump assembly 144 may direct wash fluid collected in sump 142 to spout 154 in order to circulate wash fluid in tub 124.

As illustrated in FIGS. 1 and 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

In addition, a water supply valve or control valve 158 may provide a flow of water from a water supply source (such as a municipal water supply 155) into detergent dispenser 156 and/or into tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 including a plurality of input selectors 162 is coupled to front panel 130 as illustrated in FIG. 1. Control panel 160 and input selectors 162 collectively form a user interface input for operator selection of machine cycles and features. For example, in one embodiment, a display 164 indicates selected features, a countdown timer, and/or other items of interest to machine users.

Operation of laundry appliance 100 is controlled by a controller or processing device 166 (FIG. 1) that is operatively coupled to control panel 160 for user manipulation to select laundry cycles and features. The controller 166 may be operably coupled to mechanical and electrical components of the laundry appliance 100. In response to user manipulation of control panel 160, controller 166 operates the various components of laundry appliance 100 to execute selected machine cycles and features. For example, the controller 166 may be operably coupled to the motor 122 to rotate the basket 120 during a drying cycle.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into laundry basket 120 through opening 132, and washing operation is initiated through operator manipulation of input selectors 162. Tub 124 is filled with water, detergent, and/or other fluid additives, e.g., via spout 154 and or detergent drawer 156. One or more valves (e.g., control valve 158) can be controlled by laundry appliance 100 to provide for filling laundry basket 120 to the appropriate level for the number of articles being washed and/or rinsed. By way of example for a wash mode, once laundry basket 120 is properly filled with fluid, the contents of laundry basket 120 can be agitated (e.g., with ribs 128) for washing of laundry items in laundry basket 120.

After the agitation phase of the wash cycle is completed, tub 124 can be drained. Laundry articles can then be rinsed by again adding fluid to tub 124, depending on the particulars of the cleaning cycle selected by a user. Ribs 128 may again provide agitation within laundry basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in laundry basket 120 are cleaned, washed, and/or rinsed, washer and condenser dryer combination appliance 100 can be operated to dry the laundry articles as will be discussed in greater detail below. Alternately, the user can remove the articles from laundry basket 120, e.g., by opening door 134 and reaching into laundry basket 120 through opening 132.

While described in the context of a specific embodiment of horizontal axis washer and condenser dryer combination appliance 100, using the teachings disclosed herein it will be understood that the exemplary appliance 100 is provided by way of example only. Other laundry appliances having different configurations, different appearances, and/or different features may also be utilized with the present subject matter as well. Indeed, it should be appreciated that aspects of the present subject matter may further apply to other laundry appliances.

Referring still to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100.

External communication system 170 permits controller 166 of laundry appliance 100 to communicate with external devices either directly or through a network 172. For example, a consumer may use a consumer device 174 to communicate directly with laundry appliance 100. For example, consumer devices 174 may be in direct or indirect communication with laundry appliance 100, e.g., directly through a local area network (LAN), Wi-Fi, Bluetooth, Zigbee, etc. or indirectly through network 172. In general, consumer device 174 may be any suitable device for providing and/or receiving communications or commands from a user. In this regard, consumer device 174 may include, for example, a personal phone, a tablet, a laptop computer, or another mobile device.

In addition, a remote server 176 may be in communication with laundry appliance 100 and/or consumer device 174 through network 172. In this regard, for example, remote server 176 may be a cloud-based server 176, and is thus located at a distant location, such as in a separate state, country, etc. In general, communication between the remote server 176 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 172 can be any type of communication network. For example, network 172 can include one or more of a wireless network, a wired network, a personal area network, a local area network, a wide area network, the internet, a cellular network, etc. According to an exemplary embodiment, consumer device 174 may communicate with a remote server 176 over network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 3:
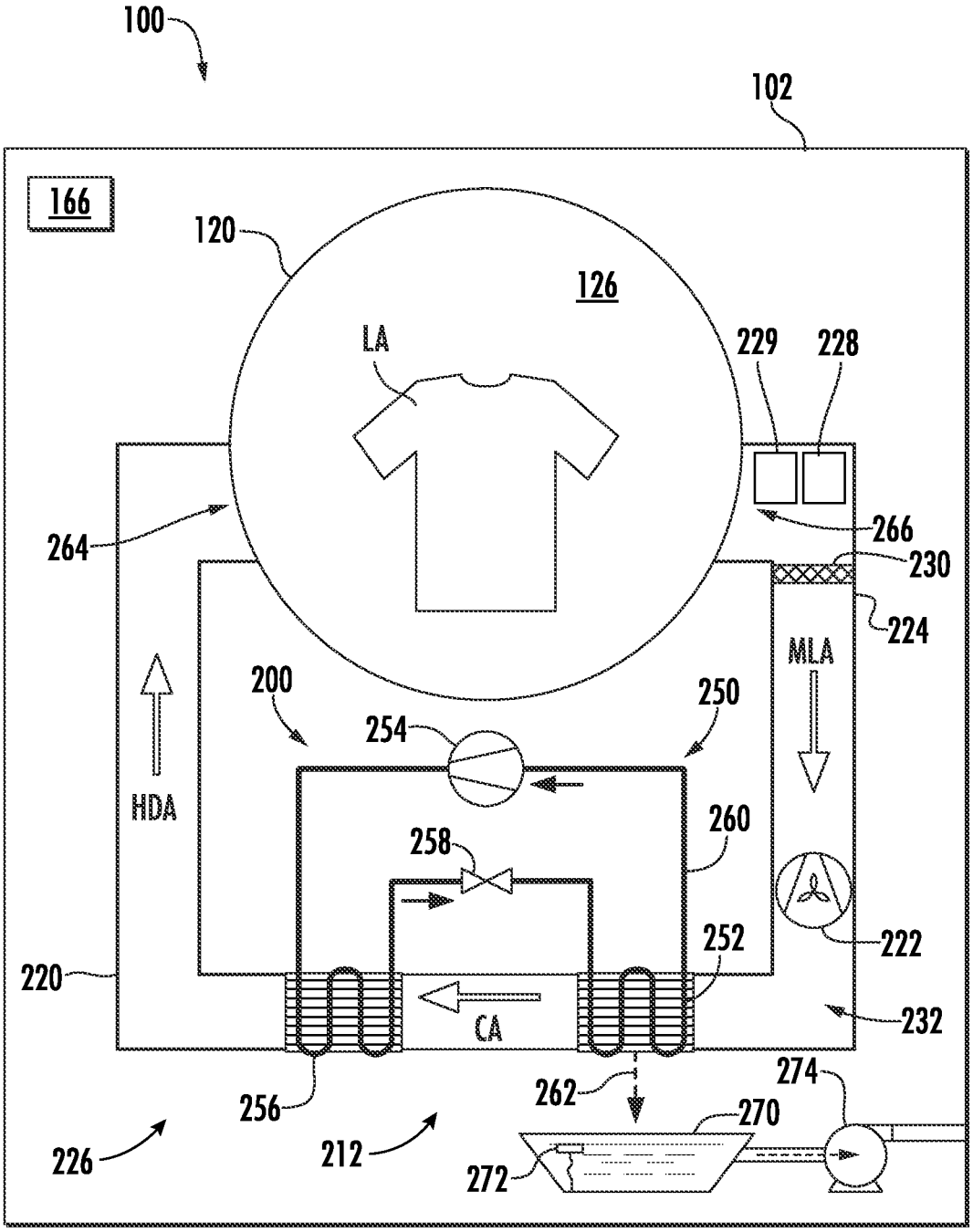
FIG. 3 provides a schematic diagram of an exemplary condenser dryer appliance and a conditioning system thereof in accordance with exemplary embodiments of the present disclosure.
Figure 4:
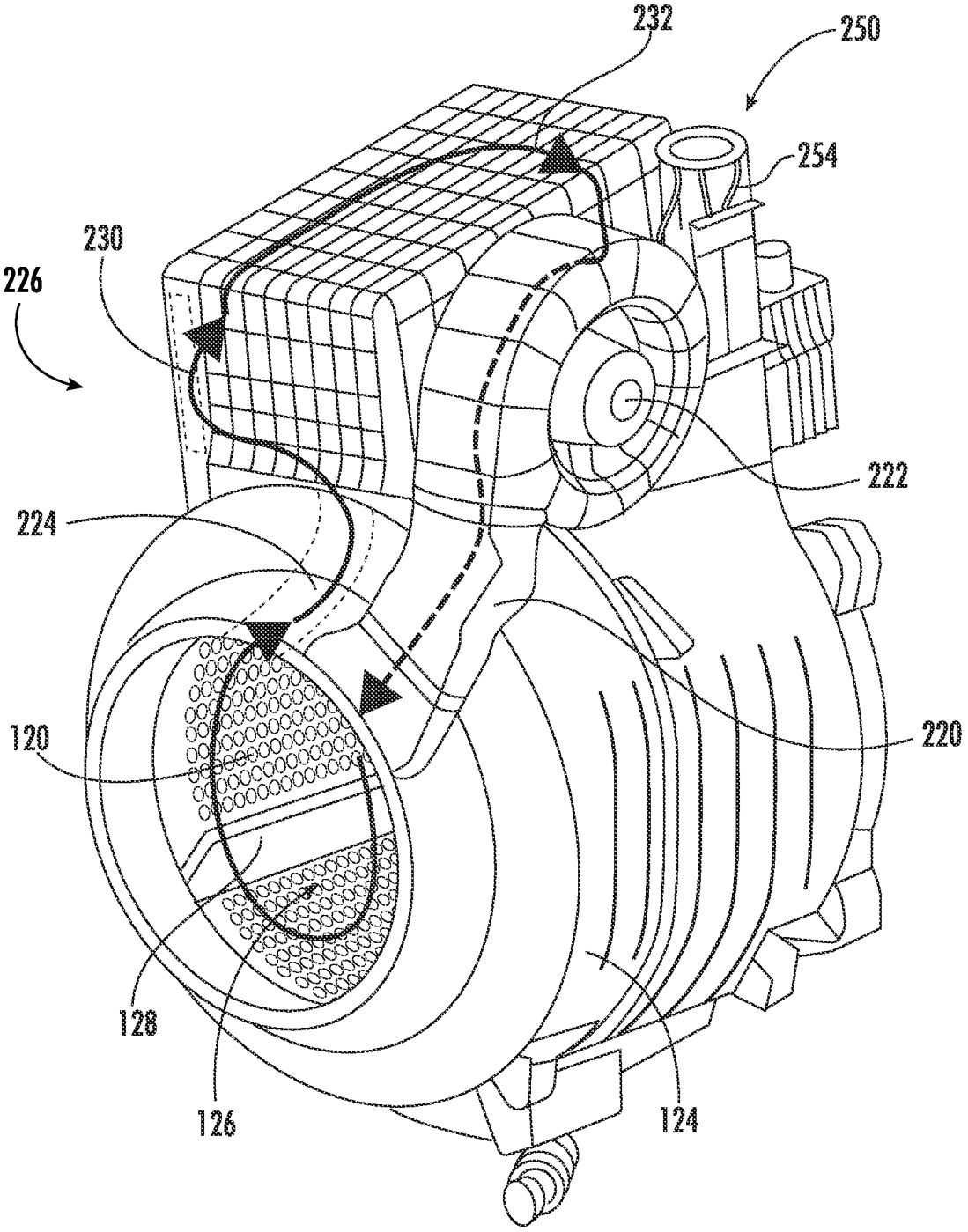
FIG. 4 provides a perspective view of the example laundry appliance of FIG. 1 with a cabinet of the laundry appliance removed to reveal certain components of the dryer appliance.

Referring now specifically to FIGS. 2 through 4, features of a heat pump system, a condenser system, a refrigerant-based air conditioning system, a heat exchanger, or another suitable conditioning system 200 for facilitating a drying process within laundry appliance 100 will be described in more detail. The controller 166 may be operably coupled to the conditioning system 200 to control the drying process by selectively operating the conditioning system 200 components (e.g., the evaporator 252 and the condenser 254) and the blower fan 222. For example, the controller 166 may energize the evaporator 252 and the condenser 254 of the conditioning system 200 during portions of the drying process, in cooperation with selective energizing of the blower fan 222, to dry damp laundry articles. As illustrated, conditioning system 200 may be mounted to tub 124 such that it is fluidly coupled to chamber 126. More specifically, as illustrated, tub 124 extends between a front portion 202 and a back portion 204, e.g., along the transverse direction T. Laundry basket 120 also includes a back or rear wall 206, e.g., at back portion of laundry basket 120 or proximate back portion 204 of tub 124. Rear wall 206 of laundry basket 120 may be rotatably supported within cabinet 102 by a suitable bearing.

Laundry basket 120 is generally cylindrical in shape having an outer cylindrical wall 208 and a front flange or wall that defines an opening 210 of laundry basket 120, e.g., at front portion 202 of laundry basket 120. As shown, opening 210 generally coincides with opening 132 of front panel 130 of cabinet 102, e.g., to provide user access to chamber 126 for loading and unloading of articles into and out of chamber 126 of laundry basket 120.

Conditioning system 200 may generally include a return duct 220 that is mounted to tub 124 for circulating process air (i.e., air used in a laundry process, for example the drying cycle) within chamber 126 to facilitate a drying process. For example, according to the illustrated exemplary embodiment, return duct 220 is fluidly coupled to tub 124 proximate a top of tub 124 (FIG. 2). Return duct 220 receives process air that has been heated and/or dehumidified by a heat exchanger 212 portion of conditioning system 200, the heat exchanger 212 comprising evaporator 252 and condenser 256. The evaporator 252 corresponds to a dehumidification section and the condenser 256 corresponds to a heating section of the conditioning system 200. The return duct 220 provides the heated process air to laundry basket 120 via one or more holes defined by rear wall 206 and/or cylindrical wall 208 of laundry basket 120 (e.g., such as perforations 140). Accordingly, laundry appliance 100 comprises a recirculating process air flow system 226 including the return duct 220 and the intake duct 224. The recirculating process air flow system 226 provides fluid communication of process air between the chamber 126 and the conditioning system 200. In general, the recirculating air flow system 226, the conditioning system 200, and the basket 120 define the process air flow path 232.

Specifically, moisture laden, heated air is drawn from laundry basket 120 by an air handler, such as a blower fan 222, which generates a negative air pressure within laundry basket 120. The air passes from blower fan 222 via intake duct 224 and then is passed into conditioning system 200. In some embodiments, the conditioning system 200 may be or include an electric heating element, e.g., a resistive heating element, or a gas-powered heating element, e.g., a gas burner. According to the illustrated exemplary embodiment, laundry appliance 100 is a heat pump dryer appliance and thus conditioning system 200 may be or include a heat pump including a sealed refrigerant circuit, as described in more detail below with reference to FIGS. 3 and 4. Heated process air (with a lower moisture content than was received from laundry basket 120), exits conditioning system 200 and returns to laundry basket 120 by a return duct 220. After the clothing articles have been dried, they are removed from the laundry basket 120 via opening 132.

Blower fan 220 may be controlled by the laundry appliance 100, specifically by the controller 166. During various portions of a drying cycle, the blower fan 222 may be selectively energized by the controller 166 to operate at a plurality of speeds, for example at least at a first speed and a second speed. In some embodiments, the second speed may be less than the first speed. In some embodiments, selectively energizing the blower fan 222 may include selectively deenergizing the fan 222 for a period of time. Accordingly, when deenergized, the fan 222 may rotate at zero, or substantially zero, revolutions per minute (RPM) which may correspond to the second speed. Accordingly, at the second speed, the flow of air in the air flow path 232 may be less than the air flow at the first speed (i.e., the flow rate in cubic feet per minute (CFM) attributed to the fan operating at the first speed may be greater than the flow rate in CFM attributed to the fan operating at the second speed). In an embodiment, the air flow rate at the second fan speed may be zero, or substantially zero, for example zero CFM corresponding to the fan 222 being deenergized.

In embodiments, the controller 166 may energize the conditioning system 200 (i.e., at least one of the evaporator 252 and the condenser 254) and operate the fan 222 at the first speed during a first portion of the drying cycle (for example a heating process of laundry articles). In a second portion of the drying cycle (for example a cooling process), the controller 166 may deenergize the conditioning system 200 and operate the fan 222 at the second speed. In some embodiments, the controller may deenergize the conditioning system 200 and the fan 222, and rotate the basket 120 during the second portion of the drying cycle (for example the cooling process). The conditioning system 200 and the fan 222 may be cycled on and off, independently of each other, during one or more time periods of the drying cycle.

In some embodiments, flow control devices or air flow controls 234, such as flaps or gates, may be used in various locations in intake duct 224 or return duct 220, operable to control or facilitate control of the flow (e.g., flow rate) of process air alone, or in cooperation with the fan 222. In the exemplary embodiment of FIG. 2, two flow controls 234 are illustrated, one at the tub inlet 264 and one at the tub outlet 266, although other locations along the air flow path 232 may also be useful. For example, the fan and the exemplary flow controls 234 may be operated by the controller 166 to allow the flow of process air in air flow path 232 during portions of a drying cycle. In other portions of the drying cycle, the flow controls 234 may be operated to block, or substantially block, the flow of process air in the air flow path 232. In embodiments, one or more flow controls 234 may be operated block, or substantially block, the flow of process air through the tub 124 and basket 120 as illustrated in FIG. 2.

As shown, laundry appliance 100 may further include one or more lint filters 230 (FIG. 3) to collect lint during drying operations. The moisture laden heated air passes through intake duct 224 enclosing screen filter 230, which traps lint particles. More specifically, filter 230 may be placed into an air flow path 232 defined by laundry basket 120, conditioning system 200, intake duct 224, and return duct 220. Filter 230 may be positioned in the process air flow path 232 and may include a screen, mesh, or other material to capture lint in the air flow 232. The location of lint filters in laundry appliance 100 as shown in FIG. 3 is provided by way of example only, and other locations may be used as well. According to exemplary embodiments, lint filter 230 is readily accessible by a user of the appliance.

FIG. 3 provides a schematic view of the process air portion of laundry appliance 100 (i.e., the dryer portion) and depicts conditioning system 200 in more detail. FIG. 4 provides a perspective view of tub 124 with conditioning system 200 positioned on top of tub 124. For this embodiment, laundry appliance 100 is a washer and condenser dryer combination appliance 100 and thus conditioning system 200 includes a sealed system 250. Sealed system 250 includes various operational components, which can be encased or located within a machinery compartment of laundry appliance 100. Generally, the operational components are operable to execute a vapor compression cycle for cooling/dehumidifying moisture laden process air and then heating the dehumidified process air passing through conditioning system 200. The operational components of sealed system 250 include an evaporator 252, a compressor 254, a condenser 256, and one or more expansion devices 258 connected in series along a refrigerant circuit or line 260. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components, e.g., at least one additional evaporator, compressor, expansion device, and/or condenser.

In performing a drying and/or tumbling cycle, one or more laundry articles LA may be placed within the chamber 126 of laundry basket 120. Hot dry air HDA is supplied to chamber 126 via return duct 220. The hot dry air HDA enters chamber 126 of laundry basket 120 via a tub inlet 264 defined by laundry basket 120, e.g., through the plurality of holes 140 defined in rear wall 206 and/or cylindrical wall 208 of laundry basket 120 as shown in FIG. 2. The hot dry air HDA provided to chamber 126 causes moisture within laundry articles LA to evaporate. Accordingly, the air within chamber 126 increases in water content and exits chamber 126 as warm moisture laden air MLA. The warm moisture laden air MLA exits chamber 126 through a tub outlet 266 defined by laundry basket 120 and flows into intake duct 224.

After exiting chamber 126 of laundry basket 120, the warm moisture laden air MLA flows downstream to conditioning system 200. Blower fan 222 moves the warm moisture laden air MLA, as well as the air more generally, through a process air flow path 232 defined by laundry basket 120, conditioning system 200, intake duct 224, and return duct 220. Thus, generally, blower fan 222 is operable to move air through or along the process air flow path 232. The duct system includes all ducts that provide fluid communication (e.g., airflow communication) between tub outlet 266 and conditioning system 200 and between conditioning system 200 and tub inlet 264. Although blower fan 222 is shown positioned between laundry basket 120 and conditioning system 200 along intake duct 224, it will be appreciated that blower fan 222 can be positioned in other suitable positions or locations along the duct system.

As further depicted in FIG. 3, the warm moisture laden air MLA flows into or across evaporator 252 of the conditioning system 200. As the moisture-laden air MLA passes across evaporator 252, the temperature of the air is reduced through heat exchange with refrigerant that is vaporized within, for example, coils or tubing of evaporator 252. This vaporization process absorbs both the sensible and the latent heat from the moisture-laden air MLA, thereby reducing its temperature. As a result, moisture in the air is condensed on evaporator 252 as liquid water and such condensate water may be drained from conditioning system 200, e.g., using a drain line 262, which is also depicted in FIG. 3.

For this embodiment, a condenser tank or a condensate collection tank 270 is in fluid communication with conditioning system 200, e.g., via drain line 262. Collection tank 270 is operable to receive condensate water from the process air flowing through conditioning system 200, and more particularly, condensate water from evaporator 252. A sensor 272 is operable to detect when water within collection tank 270 has reached a predetermined level. Sensor 272 can be any suitable type of sensor, such as a float switch as shown in FIG. 3. Sensor 272 can be communicatively coupled with controller 166, e.g., via a suitable wired or wireless communication link. A drain pump 274 is in fluid communication with collection tank 270. Drain pump 274 is operable to remove a volume of water from collection tank 270 and, for example, discharge the collected condensate to an external drain. In some embodiments, drain pump 274 can remove a known or predetermined volume of water from collection tank 270. Drain pump 274 can remove the condensate water from collection tank 270 and can move or drain the condensate water downstream, e.g., to a gray water collection system. Particularly, in some embodiments, controller 166 is configured to receive, from sensor 272, an input indicating that water within the collection tank has reached the predetermined level. In response to the input indicating that water within collection tank 270 has reached the predetermined level, controller 166 can cause drain pump 274 to remove the predetermined volume of water from collection tank 270.

Air passing over evaporator 252 becomes cooler than when it exited laundry basket 120 at tub outlet 266. As shown in FIG. 3, cool air CA (cool relative to hot dry air HDA and moisture laden air MLA) flowing downstream of evaporator 252 is subsequently caused to flow across condenser 256, e.g., across coils or tubing thereof, which condenses refrigerant therein. The refrigerant enters condenser 256 in a gaseous state at a relatively high temperature compared to the cool air CA from evaporator 252. As a result, heat energy is transferred to the cool air CA at the condenser 256, thereby elevating its temperature and providing hot dry air HDA for resupply to laundry basket 120 of laundry appliance 100. The hot dry air HDA passes over and around laundry articles LA within the chamber 126 of the laundry basket 120, such that warm moisture laden air MLA is generated, as mentioned above. Because the air is recycled through laundry basket 120 and conditioning system 200, laundry appliance 100 can have a much greater efficiency than traditional clothes dryers can where all of the warm, moisture-laden air MLA is exhausted to the environment.

As illustrated in FIG. 3, intake duct 224 includes sensors to measure the temperature and humidity of the air exiting the basket 120. For instance humidity sensor 228 and temperature sensor 229 may be located along the flow path 232 between the basket 120 and the conditioning system 200 to detect the humidity and temperature of the process air. Sensors 228, 229 may be operationally coupled to the controller 166 and provide signals to the controller proportional to the humidity and temperature. From this information, the controller 166 may be able to determine the absolute humidity of the process air, that is the actual amount of water vapor (or moisture) in the process air. This absolute humidity can be used by the controller to determine when the laundry articles in the basket are sufficiently dry for the user-selected dryer cycle.

At the absolute humidity level corresponding with the chosen dryer cycle, the controller 166 may terminate the heating portion of the dryer cycle. According to some embodiments, the laundry appliance 100 may enter a cooling portion of the dryer cycle in which the laundry articles are tumbled in the basket 120 without heating or dehumidification provided by the conditioning system 200. The rotating basket 120 tumbles the laundry articles allowing them to cool. The laundry appliance 100 may energize the fan 222 to operate at a speed less than the speed of the fan 222 during the heating portion of the cycle. In some embodiments, the speed of the fan during the cooling portion may be zero, or substantially zero, RPM, providing a zero or substantially zero flow rate in the flow path 232. As discussed above, flow controls 234 may be employed to facilitate the reduced flow rate during the cooling portion of the cycle.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool air CA from evaporator 252 flows across condenser 256, the refrigerant is cooled and its temperature is lowered as heat is transferred to the process air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. The flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden air MLA received from chamber 126 of laundry basket 120. The process is repeated as air is circulated along process air flow path 232 while the refrigerant is cycled through sealed system 250, as described above.

Although laundry appliance 100 is depicted and described herein as a washer and condenser dryer combination appliance, the inventive aspects of the present disclosure can apply to other types of closed loop airflow circuit dryer appliances. For instance, in other embodiments, laundry appliance 100 can be a condenser dryer that utilizes an air-to-air heat exchanger instead of evaporator 252 and/or an electric heater may be provided instead of condenser 256.

Now that the construction of laundry appliance 100 and the configuration of controller 166 according to exemplary embodiments have been presented, exemplary methods of operating a dryer appliance will be described. Although the discussion below refers to exemplary methods of operating laundry appliance 100, one skilled in the art will appreciate that the exemplary methods are applicable to the operation of a variety of other washer/dryer appliances. In exemplary embodiments, the various method steps as disclosed herein may be performed by controller 166 or a separate, dedicated controller.

Figure 5:
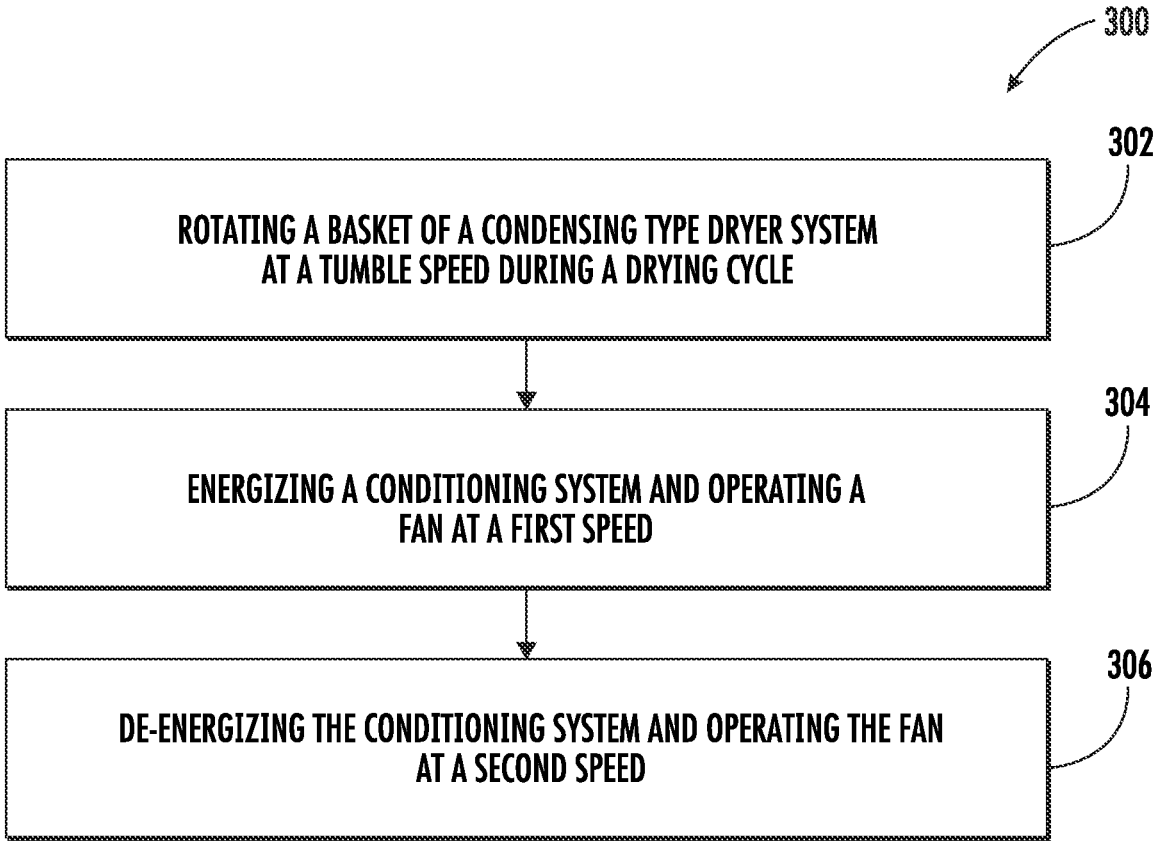
FIG. 5 illustrates a method for operating a laundry appliance in accordance with one embodiment of the present disclosure.

Referring now to FIG. 5, method 300 includes, at step 310, rotating a laundry basket 120 of a condensing type dryer system, for example in a combination washer/dryer laundry appliances 100, at a tumble speed during a drying cycle. In this regard, a typical drying operation of laundry appliance 100 begins with the controller 166 operating the motor 122 to rotate the basket at a tumble speed, for example at a rotational speed of 30-70 RPM, or a rotational speed of 40-60 RPM, for example at a rotational speed of 50 RPM. The rotational speed may be chosen based on the number of laundry articles in the basket, the material of the articles, or other factors including user selected factors input using the input selectors 162. The basket 120 rotating at tumble speed may induce an air flow through the recirculating air flow system.

Typically, a conditioning system 200 is used in cooperation with a blower or fan 222 to accelerate the drying operation in a heating portion of the drying cycle. Accordingly, step 304 includes energizing a conditioning system during the heating portion and energizing a fan to operate at a first speed. An exemplary conditioning system 200 is discussed above and includes an evaporator 252 and a condenser 256 in fluid communication with air flow path 232. When the conditioning system 200 is energized, one or more of the evaporator 252 and condenser 256 is energized and operating. When energizing the evaporator 252, the dehumidification section of the conditioning system 200 is energized. Similarly, when the condenser 256 is energized, the process air is heated by the condenser.

Fan 222 urges a recirculating flow of process air (i.e., air used in the drying process), at a flow rate corresponding to the first fan speed, from the basket 120, through the evaporator to dehumidify the process air, and to the condenser 256 (i.e., through the process air flow path) to heat the process air. The heating portion may continue until the moisture level in the laundry articles corresponds to the selected dryer cycle. The moisture level may be determined the controller 166 from humidity and temperature information provided by sensors 228 and 229. In some embodiments, the heating position of the dryer cycle is determined by user-selected time rather than degree of dryness.

At the end of the heating portion, as determined at 302, the method advances to 304. At 304, the controller instructs the laundry appliance to enter the cooling portion of the dryer cycle. In this portion of the dryer cycle, the evaporator 252 and condenser 256 are deenergized. Accordingly, no additional heat is added to the process air and no moisture is removed from the process air. The controller 166 may still instruct the motor 122 to rotate the basket 120 at a tumble speed, or at a different speed greater or less than the tumble speed. Additionally, the controller 166 may instruct the fan 222 to operate at a second speed to recirculate process air through the process air flow path 232. The second speed may be less than the first speed used in the heating portion of the dryer cycle. In some embodiments, the second speed of fan 222 may be zero, or substantially zero, RPM. Accordingly, the flow rate of process air in the air flow path 232 during the cooling portion may be less than the flow rate during the heating portion, and may be a flow rate of substantially zero CFM.

In some embodiments, during the cooling portion of the dryer cycle, the fan 222 may be deenergized and a process air flow may be induced along the air flow path 232, with the induced air flow a result of the basket 120 rotating at the tumble speed or at another rotational speed. The induced air flow may be reduced compared to the air flow at the first fan speed, i.e., less than the first air flow (in CFM) with the fan operating at the first speed. During the cooling portion of the drying cycle, the rotational speed of the basket (i.e., tumble speed) may vary, and the induced air flow caused by the basket rotation may vary accordingly.

In embodiments, the humidity and temperature sensors 228, 229 may be in communication with the controller 166 during the cooling portion of the dryer cycle. The sensors 228, 229 may be operable to detect changes in the absolute humidity in the process air during the cooling portion. The controller 166 may use this information in operating one or more of the fan 222, the evaporator 252, or the condenser 256 during the cooling portion of the dryer cycle. For example, if an increase in the absolute humidity is detected in the process air flow path 232, the process air may be picking up residual moisture from the recirculating ai flow system 226. This added moisture may be absorbed by the laundry articles if the flow continues. Accordingly, the controller may mitigate the increase of moisture in the laundry articles by blocking the process air flow path, energizing the evaporator 252, or other suitable actions. In some embodiments, flow controls 234 may be used as described above to fluidly isolate the basket from process air flow, for example during the drying portion of the dryer cycle. The flow controls 234 may be in operative communication with the controller 166, and receive a signal to close when the absolute humidity is increasing in the process air flow path, thus keeping additional moisture from becoming reintroduced into the laundry articles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A laundry appliance comprising:

a tub positioned within a cabinet;

a basket supported for rotation within the tub, the basket defining a chamber for receipt of laundry articles for drying;

a conditioning system comprising a dehumidification section and a heating section;

a recirculating air flow system for providing fluid communication between the chamber and the conditioning system, wherein the recirculating air flow system, the conditioning system, and the basket define a process air flow path, wherein the recirculating air flow system comprises one or more flow control devices operable to control the flow of process air through the process air flow path;

a fan operable to move a flow of process air through the process air flow path; and a controller operably coupled to the conditioning system and the fan, the controller being configured to:

rotate the basket at a tumble speed during a drying cycle;

energize the conditioning system;

energize the fan to operate at a first speed to recirculate a first air flow through the recirculating air flow system during a first portion of the drying cycle;

deenergize the conditioning system; and selectively energize the fan to operate at a second speed during a second portion of the drying cycle, the second speed less than the first speed.

2. The laundry appliance of claim 1, wherein the first portion of the drying cycle is a heating process for heating the laundry articles.

3. The laundry appliance of claim 1, wherein the second portion of the drying cycle is a cooling process for allowing the laundry articles to cool.

4. The laundry appliance of claim 1, wherein energizing the conditioning system comprises energizing at least one of the dehumidification section and the heating section during the drying cycle.

5. The laundry appliance of claim 1, wherein the dehumidification section comprises an evaporator.

6. The laundry appliance of claim 1, wherein the heating section comprises a condenser.

7. The laundry appliance of claim 1, wherein selectively energizing the fan during the second portion of the drying cycle includes deenergizing the fan for a time period.

8. The laundry appliance of claim 7, wherein the basket rotating at tumble speed induces an air flow through the recirculating air flow system.

9. The laundry appliance of claim 1, wherein the one or more flow control devices operate to block the flow of process air to the basket.

10. A method of operating a laundry appliance, the laundry appliance comprising a basket supported for rotation within a tub, a conditioning system comprising a dehumidification section and a heating section, a recirculating air flow system in fluid communication with the basket and the conditioning system, wherein the recirculating air flow system, the conditioning system, and the basket define a process air flow path, and a fan operable to move a flow of process air through the process air flow path, the method comprising:

rotating the basket at a tumble speed during a drying cycle;

energizing the conditioning system;

energizing the fan to operate at a first speed to recirculate a first air flow through the recirculating air flow system during a first portion of the drying cycle;

deenergizing the conditioning system; and selectively energizing the fan to operate at a second speed during a second portion of the drying cycle, the second speed less than the first speed, wherein selectively energizing the fan during the second portion of the drying cycle includes deenergizing the fan for a time period.

11. The method of claim 10, wherein operating the fan at the first speed recirculates heated process air through the process air flow path.

12. The method of claim 10, wherein operating the fan at the second speed recirculates process air through the process air flow path.

13. The method of claim 10, wherein energizing the conditioning system comprises energizing at least one of the dehumidification section and the heating section during the drying cycle.

14. The method of claim 13, wherein energizing the dehumidification section comprises energizing an evaporator.

15. The method of claim 13, wherein energizing the heating section comprises energizing a condenser.

16. The method of claim 10, wherein rotating the basket at the tumble speed induces an air flow through the recirculating air flow system.

17. The method of claim 10, wherein the recirculating air flow system comprises one or more flow control devices; and wherein the method further comprises operating the one or more flow control devices to control the flow of process air through the process air flow path.

18. The method of claim 17, wherein the method further includes operating the one or more flow control devices to block the flow of process air to the basket.

* * * * *